United States Patent [19]

Vandervaart

[11] Patent Number: 4,995,241

[45] Date of Patent: Feb. 26, 1991

[54] HIGH EFFICIENCY HEAT EXCHANGER

[75] Inventor: Gerry Vandervaart, Nigara Falls, Canada

[73] Assignee: Kool-Fire Limited, Niagara Falls, Canada

[21] Appl. No.: 406,409

[22] Filed: Sep. 13, 1989

[51] Int. Cl.[5] ..... F25B 27/00

[52] U.S. Cl. ..... 62/238.7; 62/238.6; 237/28; 165/29

[58] Field of Search ..... 62/238.7, 238.6, 503, 62/324.1; 237/2 B; 165/29

[56] References Cited

U.S. PATENT DOCUMENTS 4,112,705 9/1978 Sisk et al. ..... 165/29 X 4,429,734 2/1984 Vandervaart ..... 165/29

*Primary Examiner*—Albert J. Makay

*Assistant Examiner*—John Sollecito

*Attorney, Agent, or Firm*—Diller, Ramik, Wight

[57] ABSTRACT

A heat exchanger as provided in which an outdoor coil circulates a heat-exchange medium therethrough and includes a conventional upper inlet and lower outlet for respectively receiving and discharging the heat-exchange medium. A fan draws ambient air through the outdoor coil during the heating phase of the heat exchanger, and a gas flame generates heat to further increase the temperature of the heat-exchange medium beyond that created by the heat-absorbed from ambient air. A control system is provided for at least at times simultaneously operating the fan and the gas flame. The control system also at times bypasses the outdoor coil at extremely low ambient temperatures.

34 Claims, 1 Drawing Sheet

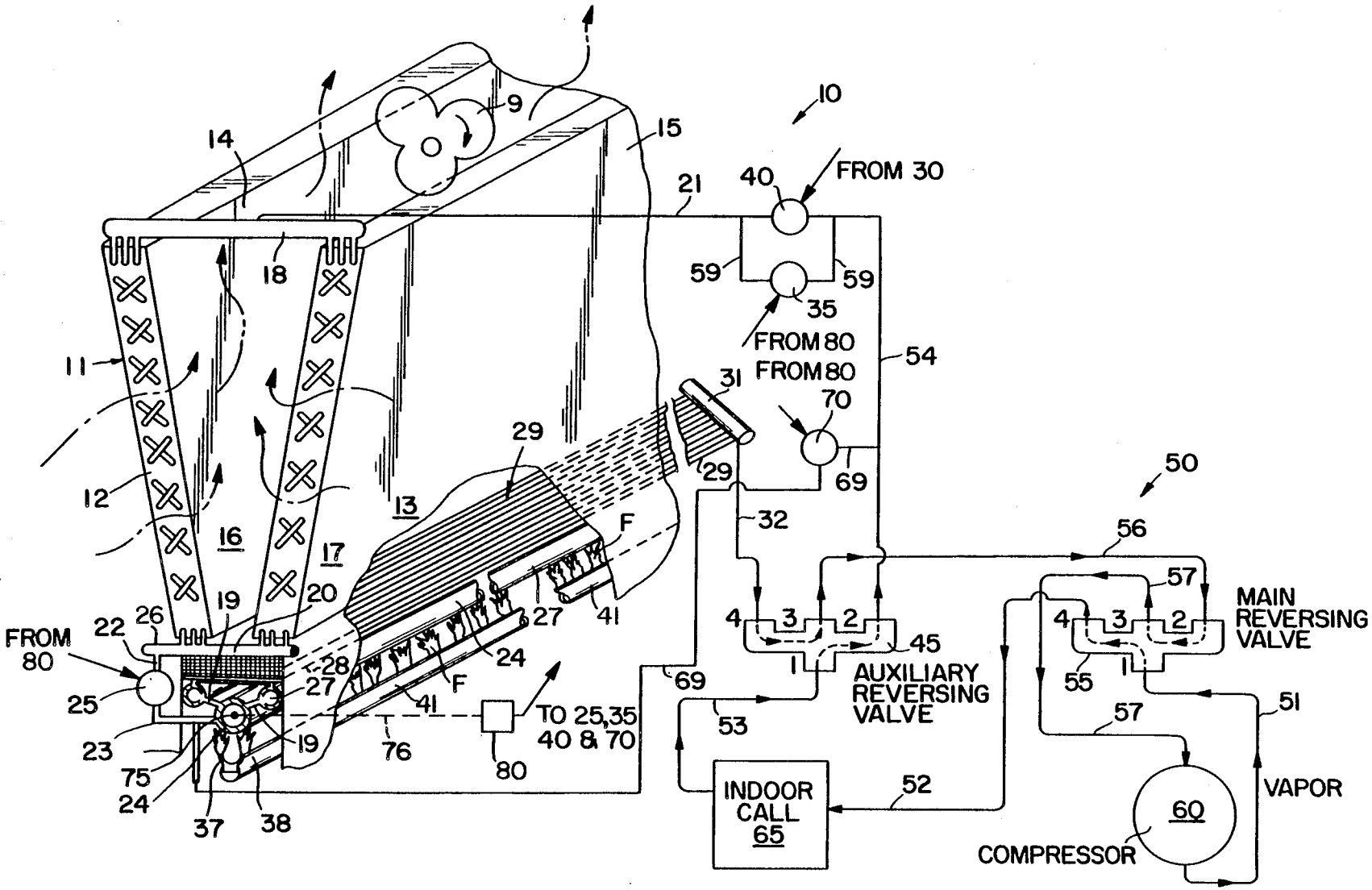
MAIN REVERSING VALVE
VAPOR
COMPRESSOR
AUXILIARY REVERSING VALVE
INDOOR CALL 65
FROM 30
FROM 80
FROM 80
FROM 80
TO 25,35 40 & 70

HIGH EFFICIENCY HEAT EXCHANGER

BACKGROUND OF THE INVENTION

The present invention relates to improvements in high efficiency heat exchangers of the type disclosed in U.S. Pat. Nos. 4,311,191 and 4,311,192, each issued on Jan. 19, 1982 in the name of Gerry Vandervaart.

The heat exchangers of the latter-noted patents were themselves modified and improved by Gerry Vandervaart, as evidenced by U.S. Pat. No. 4,461,345 issued on July 24, 1984 and U.S. Pat. No. 4,825,664 issued on May 2, 1989.

The contents of the latter four patents are incorporated herein by reference, particularly with respect to presently conventional structural and functional characteristics of such prior art heat exchangers.

DESCRIPTION OF THE RELATED ART

U S. Pat. Nos. 4,311,191 and 4,311,192 each disclose a heat exchanger which includes conventional components such as a compressor, indoor and outdoor coils, blowers or fans associated with the coils, a reversing-/expansion valve and appropriate tubing or conduits such that the heat-exchange medium/refrigerant/ boiling-off medium/heat-absorption chemical (Freon) can flow in opposite directions through associated conduits during the air conditioning or cooling phase of operation on the one hand and the heating and/or heat-augmenting phase on the other. Traditionally, heat exchangers of the type disclosed in these patents only included reversible operation for cooling and heating modes, but in these patents in the heat-augmenting mode a gas burner directs flames against the outdoor coil as the heat-exchange medium refrigerant is introduced therein. The liquid heat-exchange medium absorbs the heat/BTU's which increases its temperature resulting in a vapor phase exiting the outdoor coil which is subsequently transferred to the indoor coil and utilized with the indoor blower to heat the interior of an associated building.

Though the heat exchanger of U.S. Pat. Nos. 4,311,191 and 4,311,192 was highly efficient, maximum boil-off of the liquid heat-exchange medium was not achieved. However, the subsequent improvements to the heat exchanger, particularly as disclosed in U.S. Pat. No. 4,825,664, carried the efficiency to a high level by (a) introducing the liquid heat-exchange medium into the top of the outdoor coil during the heat pump and heat augmenting phases of operation, (b) separating the outdoor coil into several stages, each having its own vapor inlet and outlet, and (c) providing cross-over tubing between different sections of the outdoor coil.

From the initial heat exchanger of the first-mentioned patents to those patents most recently issued, the heat exchangers have three distinctive modes of operation, namely, (a) the air-conditioning mode or phase, (b) the air-to-air heat pump mode or phase and (c) the gas-augmented flame mode or phase. These modes or phases of operation were also singular and definite and by that it is meant that when the air-to air heat pump phase was in operation, the gas burner was inoperative (no flame). However, when the gas-augmented flame mode was operative, the burner was "on" emitting a flame therefrom and the air-to-air phase was inoperative. In other words, when the burner of the outdoor coil was "on", the ambient air fan of the outdoor coil was off and vice versa. This type of operation was extended to defrosting the outdoor coil in which during frosting of the outdoor coil the air-to-air heat pump phase was cut off and the gas-augmented flame phase was cut on. The flame from the gas burner generated heat/BTU's which were absorbed by the heat exchange medium in the outdoor coil which in turn defrosted the frost on the outdoor coil.

In the gas-augmented flame mode of operation, the heat-exchanger gave an overall superior efficiency of approximately 95 to 97% at 17° F. In the air-to air heat pump mode the efficiency was between 170 to 200%. The combination of the air-to-air heat pump mode and the gas-augmented flame mode provide an overall high efficiency operating range of approximately 140–150%.

A major drawback of the heat exchanger thus far described even at the approximate 140%–150% of high efficiency, was that too much energy was wasted both during the air-to-air heat pump mode and the gas augmented flame mode of operation. In the air-to-air heat pump mode too much energy went into driving the fan to move the air across the outdoor coil which was housed in a relatively small area prohibitive of high air velocities. Since the outdoor coil was essentially encased in an enclosed cabinet or housing, the coil was not exposed to ambient air and high horse power motors were necessary to drive air across the coils to achieve heat transfer. During the gas-augmented flame mode, the head generated by the flame essentially became trapped by the outdoor coil raising the suction pressure inside the outdoor coil and thus correspondingly raising the pressure (to approximately 55° FM.). This created heat losses of 5%–8% from heat radiating away from the coil into the cabinet which is not absorbed by the heat exchange medium and, thus, escapes to ambient causing a reduction in the overall efficiency. Obviously, while the burner is heating up the outside coil and the heat is being trapped by the outside coil, none of the high efficiency benefits of the air-to-air heat pump mode are being achieved because the latter is inoperative. Thus, in either case the operation of the heat exchanger provided the efficiency of one mode of operation, but not both simultaneously.

SUMMARY OF THE INVENTION

The present invention solves the problems just noted by providing a novel heat exchanger of the type disclosed in the latter-known Vandervaart patents, except control means are provided for at least at times operating the heat exchanger simultaneously in both its gas augmented flame phase and its air-to-air heat pump phase during the heating cycle/operation (non-air-conditioning mode) of the heat exchanger. By this simultaneous operation of the air-to-air heat pump phase and the gas-augmented flame phase, the high efficiency of each is continuously available and utilized during a heating cycle.

As in the earlier heat exchangers, the heat-exchange medium is fed into the outdoor coil from the top which allows the heat-exchange medium to boil off as it descends and flows through the coils or tubes toward the outlet of the outdoor coil near the bottom thereof. This occurs while the fan or blower operates to draw ambient air through the outdoor coil, and at least for a portion of the heating cycle the burner is inoperative. The heat exchange medium is essentially preheated as it boils off during its descent through the outdoor coil and eventually exits the outdoor coil and is collected in an accumulator or a reservoir which can be isolated from the outdoor coil by a valve. When the latter valve is opened, the preheated heat-exchange medium flows into and collects in the accumulator or reservoir until eventually a level-detecting switch therein indicates that the accumulator is substantially filled. At this point the valve between the outdoor coil and the accumulator is closed and a burner beneath the accumulator is ignited. The heat from the flame of the burner is substantially absorbed (60%–80%) because of the liquid state of the heat-exchange medium in the accumulator. This high absorption takes place because when the extreme heat from the flame of the burner strikes the accumulator, a violent boiling reaction of the heat-exchange medium takes place and the heat-exchange liquid is immediately changed into its vapor phase at a virtually instantaneous rate of speed. This instantaneous vaporization also forces the liquid vapor through a secondary flue gas absorber located about the accumulator so that the hot flue gases, those from which the heat has not been totally absorbed by the heat exchange medium in the accumulator, rise through the secondary flue gas absorber. The liquid which has not yet boiled-off and is flowing through the secondary flue gas absorber keeps the secondary flue gas absorber cold. Therefore, by the time the flue gases pass through the secondary flue gas absorber, the flue gases will have the heat drawn therefrom by the heat-exchange medium passing through the secondary flue gas absorber and the latter therefor will become extremely cold. The heat-exchange medium will be completely changed into a vapor as it passes through the secondary flue gas absorber coil and flows to the compressor as a harmless vaporless refrigerant at a temperature of approximately 50° F.

During the boiling-off of the liquid heat-exchange medium in the accumulator, the heat exchange medium from the indoor coil is fed to the top of the outdoor coil preferably through a restricted bypass valve which reduces the normal flow rate capacity from the compressor to approximately 40% thereof. This reduction of the flow rate of the heat-exchange medium from the capacitor provides a greater pressure drop which removes more heat from the discharge gas and the low pressure heat-exchange medium in the outdoor coil remains in the outdoor coil long enough to warm-up to ambient. The restricted flow of the heat-exchange medium enters the outdoor coil and continues to flow downwardly therein during the time that the burner remains ignited and, of course, the valve between the outdoor coil outlet and the accumulator is closed. Thus during the operation of the burner to boil-off the heat-exchange medium in the accumulator, the liquid refrigerant descending in the outdoor coil is subject to ambient air drawn through the coil by the fan which, as heretofore noted, remains operative.

Subsequently, the temperature/pressure within the accumulator will reach approximately 5 psi which indicates that all of the liquid heat-exchange medium has boiled-off and nothing remains in the accumulator or the secondary flue gas absorber coil other than light heat-exchange vapor. At this point the valve downstream of the outdoor coil outlet can be opened and another valve in parallel with the bypass valve fully opened to allow the full rate of compressor flow of the heat exchange medium into the outdoor coil inlet. The heat exchange medium then continues to roll down and boil-off through the outdoor coil as the ambient air is drawn therethrough by the continuously operative outdoor fan. When the liquid level/pressure/temperature in the accumulator is at its desirable value, the valve at the outlet of the outdoor coil is closed, the burner comes on, the outdoor coil fan continues to run, the inlet valve is closed to the outdoor coil, the restrictor valve to the outdoor coil is opened, and the flame boiling off of the preheated liquid refrigerant in the accumulator coil once again takes place. Obviously this process repeats itself as long as there is an indoor temperature demand which can not be satisfied by the air to-air heat pump mode alone.

With the above and other objects in view that will hereinafter appear, the nature of the invention will be more clearly understood by reference to the following detailed description, the appended claims and the several views illustrated in the accompanying drawings.

BRIEF DESCRIPTION OF THE DRAWING

The single FIGURE of drawing is a schematic view of a novel heat-exchange system of the present invention, and illustrates an outdoor coil through which ambient air is drawn by a fan, an inlet for a heat-exchange medium, an outlet for the heat-exchange medium, an accumulator for collecting the preheated heat-exchange medium, and a control system for controlling the direction of flow of the heat-exchange medium during each of several modes of operation of the heat exchange system.

DESCRIPTION OF THE PREFERRED EMBODIMENTS

A novel heat-exchange system constructed in accordance with this invention is illustrated in the drawing, and a heat exchanger thereof is generally designated by the reference numeral 10.

The heat exchanger 10 includes an outdoor coil 11 which is a generally V-shaped coil, although the same may be an A-coil of the type disclosed in the latter-identified patents, or a square-shaped or a round-shaped coil. Irrespective of the particular configuration of the coil, in the present embodiment of the invention the V-shaped coil 11 includes a pair of sides or legs 12, 13 having respective upper and lower ends or end portions 14, 15 and 16, 17, respectively.

A heat-exchange medium inlet header or manifold 18 is in fluid communication with the various coils (collectively unnumbered) of the outdoor coil 11 while a heat-exchange medium outlet header or manifold 20 is similarly in fluid communication with the coils of the outdoor coil 11. The inlet manifold 18 is located at the upper end of the outdoor coil 11 while the outlet manifold 20 is located at the lower end of the outdoor coil 20. An inlet line 21 is connected to the inlet manifold 18, while an outlet line 22 is connected to the outlet manifold 20. A heat-exchange medium, such as Freon or a similar heat-absorption chemical or boiling-off medium, is introduced from the line 21 into the inlet manifold 18 during both the air-to-air heat pump mode or phase of operation and the gas-augmented flame mode or phase of operation, as will be described more fully hereinafter. However, during both of the latter-noted modes or phases of operation, the heat-exchange medium descends downwardly through the coils of the sides 12, 13 of the outdoor coil 11, and during this descent, a fan 9 is suitably rotated to draw ambient air through the sides 12, 13, as indicated by the unnumbered headed arrows in the drawing. As the heat-exchange medium enters in liquid form and descends through the coils of the outdoor coil 11, the heat-exchange medium absorbs heat/-

BTU's, becomes warmer, and eventually discharges into the outlet manifold 20.

Valve means 25 in the form of an electrically controlled "on"-"off" valve controls the flow of the heat-exchange medium from the outlet line 22 into a line 23 which flows into an accumulator or reservoir 24 in the form of an elongated copper tube which extends along the length of the outdoor coil 11 and is generally positioned along a vertical medial plane between the sides 12, 13 of the outdoor coil 11. A pair of lines or ducts 19, 19 place the interior of the accumulator or reservoir 24 in fluid communication with a pair of secondary accumulators, reservoirs or shock tubes 26, 27, each of which has an outlet connected to a common inlet header 28 of a secondary flue gas absorber coil 29 which similarly runs the length of the outdoor coil 11 immediately adjacent the bottom of the sides 16, 17. The secondary flue gas absorber 29 had an outlet manifold 31 which is connected by a line 32 to an auxiliary reversing valve 45 of a heat-exchange medium flow control system 50. The auxiliary reversing valve 45 has four ports numbered 1 through 4 as does a main reversing valve 55.

The heat-exchange medium flow control system 50 also includes as a part thereof a valve means 40 in the form of and "on"-"off" valve and valve means 35 in the form of a restrictor valve which limits the normal 100% flow rate from a compressor 60 through an indoor coil 65 to approximately 40% during the gas augmented flame mode or phase of operation of the heat-exchange system 10, as will be described more fully hereinafter.

Means for generating heat in the form of a gas burner 41 is positioned generally beneath and along the length of the reservoir or accumulator 24. The burner means 41 includes a pair of generally parallel orifices running the length of the burner tube 41 from which flames F emanate during the gas-augmented flame mode or phase of operation.

As was noted earlier herein, during the air-to-air and the gas-augmented flame modes or phases of operation, the fan 9 is at all times operative even though the burner 41 is cycled between its "on" (flame) and "off" (no flame) operations. However, when temperatures become extremely cold and the fan 9 is rendered inoperative, another valve 70 becomes operative to bypass the outdoor coil 11.

Finally, during the operation of the heat-exchange system 10, it is at times necessary to determine the level of the heat exchange medium within the accumulator or reservoir 24, and this may be accomplished by a conventional liquid level detector 75 located within the accumulator 24 at a particular location. The liquid level detector 75 can, as well, be a pressure/temperature sensor, and in any event the output thereof is connected via a conductor or wire 76 to a conventional signal generator 80.

AIR-TO AIR HEAT PUMP MODE OF OPERATION

In the air-to-air heat pump mode or phase of operation, the fan 9 is "on" or rotating, the valve 40 is opened, the valve 35 is closed, the valve 70 is closed, the valve 25 is opened, the burner 41 is "off" and the level/pressure detector 75 and is associated signal generator 80 are inoperative. The auxiliary reversing valve 45 and the main reversing valve 55 are shifted through appropriate valving (spool valve) to achieve the flow of the heat-exchange medium therethrough in the manner indicated by the unnumbered headed arrows associated therewith.

The heat-exchange medium (Freon) flows under the operation of the compressor 60 over a line 51 into the #1 port of the main reversing valve 55 and exits the #4 port thereof into a line 52. The compressor 60 increases the pressure and thus the temperature of the heat-exchange medium and this hot vapor phase is introduced by the line 52 into the indoor coil 65 through which air is blown by a conventional fan (not shown) absorbing the heat of the vapor phase refrigerant, heating the interior of a building or the like with which the indoor coil 65 is associated, and progressively cooling the refrigerant which exits the indoor coil via a line 53. The line 53 introduces the heat-exchange medium into the #1 port of the auxiliary reversing valve 45 which then exits therefrom through the #2 port and enters a line 54. The heat-exchange medium flows through the open valve 40, the line 21 and the inlet manifold 18 into the outdoor V-coil 11 descending through the coils downwardly and eventually exiting into the outlet manifold 20. As the fan 9 draws ambient air through the coil 11, some of the liquid boils off to form a liquid vapor. This heat exchange medium passes through the open valve 25, the line 23, the accumulator 24, the ducts 19, 19, the shock tubes 26, 27, the header 28, the secondary flue gas absorber coil 29 and the outlet manifold 31 thereof. The heat-exchange medium continues through the line 32, the #4 port of the auxiliary reversing valve 45 exiting the latter through the #3 port and continuing through a line 56 to the #2 port of the main reversing valve 55 exiting the latter at the #3 port. The #3 port is connected by a line 57 to the suction side of the compressor 60, thus completing the circuit of the heat-exchange medium through the flow control system or circuit 50.

GAS AUGMENTED FLAME MODE OR PHASE

As the outdoor ambient temperature decreases, an ambient temperature sensor (not shown) switches over the heat-exchanger system 10 to operate in the gas augmented flame mode in the manner specifically described in U.S. Pat. Nos. 4,311,191 and 4,311,192. When, for example, the ambient outside temperature is relatively low as, for example, 32° F. or below, the igniter (not shown) for the heat-generating or gas burner 41 will open a gas valve to introduce gas into the burner 41 and ignite the flames F, but only when a predetermined level of the liquid heat-exchange medium is sensed by the sensing means 75 in the accumulator 24. In this mode of operation, the valve 70 remains closed at all times. Initially, the valves 25 and 40 are opened and the heat-exchange medium enters the V-shaped coil 11 through the inlet manifold 18 descending and boiling-off during the descent and eventually exiting the outdoor coil 11 through the manifold 20 and entering the accumulator 24 through the line 22, the now opened valve 25 and the line 23. As the level/pressure detector 75 senses the predetermined level/pressure of the preheated heat-exchange medium within the accumulator 24, a signal is transmitted via the conduit 76 to the signal generator 80 which in turn sends a signal to close the valves 25, 40 and open the valve 35. The same signal from the signal generator 40 opens the gas valve and operates the electronic igniter of the burner 41 which in turn generates the flames F issuing from the burner orifices 37, 38. When the extreme heat of the flames F strikes the copper accumulator tube 24, a violent boiling reaction takes place and the preheated liquid heat-exchange medium is virtually instantaneously changed into a vapor which is forced through the ducts 19, 19 as it expands into the shock tubes 26, 27 and from the latter into the inlet header 28 and the coils of the secondary flue gas absorber coil 29. As the heat or BTU's from the flames F are absorbed, the flue gases become cooler, though not all of the heat is absorbed by the heat-exchange medium in the accumulator 24 or the shock tubes 26, 27. Thus, as the flue gases from the flames F pass through the coils of the secondary flue gas absorber 29, any liquid in the latter continues to boil-off as it absorbs heat from the flue gases and keeps the secondary flue gas absorber coils relatively cold. Therefore, by the time the flue gases pass through, above and beyond the secondary flue gas absorber coil 29, the flue gases are extremely cold and the heat-exchange medium within the secondary flue gas absorber coil is transformed completely into a hot vapor which exits the line 32 and follows the same path of travel heretofore described relative to the air-to air heat pump mode or phase of operation returning to the compressor via the line 55, entering the main reversing valve 55, exiting the latter through the line 52, and entering the indoor coil 65.

During the boiling-off of the preheated refrigerant, the closed valve 25 prevents high pressure vapor from flowing backwards through the system via the line 23 which would otherwise undesirably condense the vapor and the outdoor coil 11 would remove the heat that the burner has put into the preheated liquid heat-exchange medium in the accumulator 24 when transforming it to its vapor phase. Thus, all of the heat-exchange medium exits the manifold 31 and none flows backward through the system because of the closed valve 25.

During the operation of the burner 31, the fan 9 remains operative and rotating to continue to draw ambient air through the coils of the outdoor coil 11. However, during the generation of the heat by the flames F, the valve 40 remains closed and a flow restrictor valve 35 in a parallel line 59 between the lines 54, 51 is opened by the signal generator 80. Thus, the heat-exchange medium from the compressor 60 flows eventually through the line 54 into the line 59, through the restrictor valve 35 and into the line 21, the inlet manifold 18 and the upper end of the outdoor coil 11. The purpose of the restrictor valve 35 is to allow approximately 40% of the normal flow rate capacity of the compressor 65 to flow through the line 21 when the burner 41 is operative and the flames F "on." This permits a greater pressure drop which in turn removes more heat from the discharge gas during the flame mode of operation and the low pressure heat-exchange medium is retained in the outdoor coil long enough to warm-up to ambient under the influence of the ambient air drawn therethrough by the fan 9. Thus, as the burner 41 generates the flames F, the outdoor fan 9 remains running with the valves 25, 40 closed. However, because the restrictor valve 35 is opened, it allows the heat exchange medium in the outdoor coil 11 to be warmed-up to ambient which in turn allows the heat-exchange medium to absorb more heat or BTU's from the air preheating the heat-exchange medium and increasing the efficiency of the overall system (approximately 50% over the normal C.O.P. for the first few minutes). Thus, the valve 40 is closed because if the heat exchange medium flowed into the outdoor coil 11 at the same rate as it was being fed by the compressor 60 through the indoor coil 65, the pressure would automatically increase within the indoor coil 11 in the absence of the ambient boiling-off that conventionally occurs as ambient air is drawn through the outdoor coil 11. For example, if the indoor coil (condenser) had a pressure head of 300 lbs., the rate of the warm heat-exchange medium into the outdoor coil (evaporator) 11 is quite high and the temperature would rise to ambient without the benefit of withdrawing heat/BTU's from the air drawn through the outdoor coil 11. However, because of the lower flow rate through the bypass valve 35, the pressure drop is less while the burner is operating and boiling-off continues under the influence of ambient air drawn through the outdoor coil 11 by the continuously operative and rotating fan 9.

When all of the vapor has been absorbed by the compressor 60 from the secondary flue gas absorber coil 29, the shock tubes 26, 27 and the accumulator 24 pressure therein decreases and is sensed by the liquid level/pressure detector 75. At approximately 5 psi the pressure sensor 75 indicates that all liquid has boiled-off, the vapor pressure is quit low, and a signal is sent via the conductor 76 to the signal generator 80 which in turn closes the valve 30 and opens the valves 25 and 40. One hundred percent flow rate is reinstituted through the line 21, refrigerant again flows down through the outdoor coil 11, boils-off during the latter, begins to again fill the accumulator 24, and upon appropriate liquid level/pressure detection by the sensor 75, the valves 75, 40 are again closed and the valve 35 is opened followed by the opening of the gas valve and the ignition of the igniter to create the flames F and recycle the gas augmented flame mode of operation. It is to be particularly noted that during the entire cycling of the burner 31 between its flame "on" and flame "off" positions, the fan 9 is at all times operative.

HEAT-AUGMENTED FLAME WITH OUTDOOR COIL CUT-OFF MODE OR PHASE

When ambient temperatures become extremely cold outdoors, that air-to-air operation is no longer efficient or feasible, and appropriate ambient temperature detector operating through the signal generator 80 causes the signal generator 30 to generate a signal which opens the valve 70 and closes the valves 25, 35 and 40. With the valves 35, 40 closed the heat-exchange medium exiting the indoor coil 65 through the line 53 and the #2 port of the auxiliary reversing valve 45 enters a bypass line 69 which includes the now-opened valve 70 which directs the heat-exchange medium into the accumulator tube 24. As a predetermined level/ pressure of the heat-exchange medium is detected by the sensor 75, a signal is generated by the signal generator 80 which again opens the gas valve and operates the igniter of the burner 41 to generate the flames F causing the instantaneous vaporization of the liquid heat-exchange medium in the accumulator 24. This vapor enters the ducts 26, 27, the shock tubes 28 and the secondary flue gas absorber coil 29 in the manner heretofore described exiting the latter to the manifold 35 and the line 32 which eventually passes back through the main reversing valve 55 and the compressor 60 into the indoor coil 65 via the line 52. In this mode of operation the fan 9 is inoperative and absolutely no heat-exchange medium flows in any fashion into or through the outdoor coil 11. Thus, the outdoor coil 11 is effectively bypassed and the air-to air heat pump mode or phase is inoperative which means that the outdoor coil 11 is not warmed-up and, therefore, there is less heat loss which saves approximately 10 per cent in heat losses that would otherwise occur if the coil were operative and radiated heat into the cabinet under extremely low temperature conditions. This mode of operation is designed for temperatures at 0° F. or below where the air-to-air heat pump mode or phase is commercially unfeasible and inefficient.

AIR-CONDITIONING MODE OR PHASE

In the air-conditioning mode or phase of operation, the heat-exchange system 10 operates in the manner disclosed and described relative to FIG. 2 of U.S. Pat. No. 4,825,664. The essential difference is that the main and auxiliary reversing valves 55, 45 are shifted such that the heat-exchange refrigerant flowing from the compressor 60 follows the following path of travel: From the compressor 60 the heat-exchange medium enters the line 51, the #1 port of the main reversing valve 55, exits the #2 port of the main reversing valve 55, flows through the line 56 into the #3 port of the auxiliary reversing valve 45, exits the #2 port of the auxiliary reversing valve 45, enters the line 54, flows through the valve 40, enters the line 21, the manifold 18, flows downwardly through the outdoor coil 11, exits the outlet manifold 20, flows through the line 22, the valve 25, line 23, the accumulator tube 24, the ducts 19, 19, the shock tubes 26, 27, the header 28, the secondary flue gas absorber coil 29, the manifold 31, the line 32, enters the #4 port of the auxiliary reversing valve 45, exits the #1 port of the auxiliary reversing valve 45, enters the line 53, flows through the indoor coil 65, exits the indoor coil 65 through the line 52, enters the #4 port of the main reversing valve 55, exits the #3 port of the main reversing valve 55, enters the line 57, and returns the compressor 60. Obviously, in this mode of operation the valves 35, 70 are closed, the gas valve and the igniter for the burner 41 are inoperative, and the fan 9 is operative to draw ambient air through the coil 11. In this manner the high pressure hot vapor heat-exchange medium when pumped through the outdoor coil 11 gives off its heat to the ambient air flowing therethrough under the influence of the fan or blower 9, and the colder liquid phase absorbs the heat blown through the coils of the indoor coil 65 thereby cooling the room or building which in turn creates a lower pressure vapor phase returned by the compressor to the inlet manifold 18 of the outdoor coil 11 to continue the air-conditioning cycle.

Although a preferred embodiment of the invention has been specifically illustrated and described herein, it is to be under stood that minor variations may be made in the apparatus without departing from spirit and scope of the invention, as defined in the appended claims.

I claim:

1. A heat exchanger comprising outdoor coil means for circulating a heat-exchange medium therethrough, said outdoor coil means having an inlet and an outlet for respectively receiving and discharging the heat-exchange medium therefrom, compressor means for compressing a vapor phase of the heat-exchange medium, means for effecting ambient air flow relative to said outdoor coil means during a heating phase of said heat exchanger whereby the heat-exchange medium absorbs heat from ambient air to elevate the temperature of said heat-exchange medium, means for generating heat to further increase the temperature of the heat-exchange medium beyond that created by the heat absorbed from ambient air, control means for at times simultaneously operating said ambient air flow effecting means and said heat-generating means, accumulator means for receiving the heat-exchange medium in its liquid phase from said outdoor coil means outlet and collecting the liquid phase heat-exchange medium therein, said heat-generating means being effective for heating the liquid phase of the heat-exchange medium while collected in said accumulator means and transforming the liquid phase heat-exchange medium into its vapor phase, means for conducting the heat-exchange medium vapor phase from said accumulator means to said compressor means whereby the vapor phase of the heat-exchange medium is compressed, and means for conducting the compressed vapor phase of the heat-exchange medium from said compressor means to said indoor coil means inlet.

2. The heat exchanger as defined in claim 1 wherein said heat-exchange medium flows in a first direction from said inlet toward said outlet during the heating phase of said heat exchanger, and means for preventing flow of the heat-exchange medium in a second direction opposite said first direction during the simultaneous operation of said ambient air flow effecting means and said heat-generating means.

3. The heat exchanger as defined in claim 1 including means for conducting the heat-exchange medium contiguous said heat-generating means while by-passing said outdoor coil means.

4. The heat exchanger as defined in claim 1 including means for restricting the flow of the heat exchange medium into said outdoor coil means inlet.

5. The heat exchanger as defined in claim 1 including means for restricting the flow of the heat-exchange medium into said outdoor coil means inlet, said heat-exchange medium flows in a first direction from said inlet toward said outlet during the heating phase of said heat exchanger, and means for preventing flow of the heat exchange medium in a second direction opposite said first direction during the simultaneous operation of said ambient air flow effecting means and said heat generating means.

6. The heat exchanger as defined in claim 1 including means for restricting the flow of the heat-exchange medium into said outdoor coil means inlet when said heat-generating means is operating.

7. The heat exchanger as defined in claim 1 including means for restricting the flow of the heat-exchange medium into said outdoor coil means inlet when said heat generating means is operating, and means for preventing the backflow of the heat-exchange medium into said outdoor coil means through said outlet when said heat-generating means is operating.

8. The heat exchanger as defined in claim 1 wherein the heat-exchange medium flows in a first direction from said outdoor coil means to said accumulator means during the heating phase of said heat exchanger, and means for preventing flow of the heat-exchange medium in a second direction opposite said first direction during the simultaneous operation of said ambient air flow effecting means and said heat-generating means.

9. The heat exchanger as defined in claim 1 wherein the heat-exchange medium flows in a first direction from said outdoor coil means to said accumulator means during the heating phase of said heat exchanger, and valve means for closing flow of the heat-exchange medium in a second direction opposite said first direction at least just prior to or substantially simultaneously with the operation of said heat-generating means.

10. The heat exchanger as defined in claim 1 wherein and said accumulator means is positioned generally below heat-generating means.

11. The heat exchanger as defined in claim 1 including further coil means downstream of said accumulator means into which the heat-exchange medium flows prior to flowing to said compressor means.

12. The heat exchanger as defined in claim 1 including further coil means downstream of said accumulator means into which the heat-exchange medium flows prior to flowing to said compressor means, and said further coil means is positioned generally adjacent said heat-generating means to be heated there by.

13. The heat exchanger as defined in claim 1 including further coil means in fluid communication with and downstream of said accumulator means into which the heat-exchange medium flows prior to flowing to said compressor means, and said further coil means is disposed generally between said outdoor coil means and said accumulator means.

14. The heat exchanger as defined in claim 1 including further coil means in fluid communication with and downstream of said accumulator means into which the heat-exchange medium flows prior to flowing to said compressor means, said further coil means is disposed generally between said outdoor coil means and said accumulator means, and said accumulator means is disposed generally between said further coil means and said heat-generating means.

15. The heat exchanger as defined in claim 1 including further coil means in fluid communication with and downstream of said accumulator means into which the heat-exchange medium flows prior to flowing to said compressor means, said further coil means is disposed generally between said outdoor coil means and said accumulator means, said accumulator means is disposed generally between said further coil means and said heat-generating means, and said heat-generating means is disposed generally more adjacent said accumulator means than said further coil means.

16. The heat exchanger as defined in claim 1 including further coil means in fluid communication with and downstream of said accumulator means into which the heat-exchange medium flows prior to flowing to said compressor means, said further coil means is disposed generally between said outdoor coil means and said accumulator means, said accumulator means is disposed generally between said further coil means and said heat-generating means, and said heat-generating means is disposed generally below said accumulator means.

17. The heat exchanger as defined in claim 1 wherein said accumulator means is a generally elongated tube.

18. The heat exchanger as defined in claim 1 wherein said heat-generating means generates a flame.

19. The heat exchanger as defined in claim 1 wherein said control means is at times operative to prevent the operation of said heat-generating means.

20. The heat exchanger as defined in claim 1 wherein said control means is at times operative to prevent the operation of said heat-generating means while maintaining the operation of said ambient air flow effecting means.

21. The heat exchanger as defined in claim 1 wherein said control means is at times operative to prevent the operation of said heat-generating means while maintaining the operation of said ambient air flow effecting means during the heating phase of the heat exchanger.

22. The heat exchanger as defined in claim 1 wherein said control means is at times operative to prevent the operation of said heat generating means while maintaining the operation of said ambient air flow effecting means during the cooling phase of the heat exchanger.

23. The heat exchanger as defined in claim 1 including means for isolating the heat-exchange medium of the accumulator means from the heat-exchange medium of the outdoor coil when the ambient air flow effecting means and the heat-generating means are simultaneously operating.

24. The heat exchanger as defined in claim 1 including means for isolating the heat-exchange medium of the accumulator means from the heat-exchange medium of the outdoor coil when the ambient air flow effecting means and the heat-generating means are simultaneously operating, and said isolating means is a valve means.

25. The heat exchanger as defined in claim 1 wherein said control means is operative in said heating phase to sequence the operation of said heat-generating means between generating and not generating heat while said ambient air flow effecting means remains operative.

26. The heat exchanger as defined in claim 25 including means for isolating the heat-exchange medium of the accumulator means from the heat-exchange medium of the outdoor coil when the ambient air flow effecting means and the heat-generating means are simultaneously operating.

27. The heat exchanger as defined in claim 25 wherein said heat exchange medium flows in a first direction from said inlet toward said outlet during the heating phase of said heat exchanger, and means for preventing flow of the heat-exchange medium in a second direction opposite said first direction during the simultaneous operation of said ambient air flow effecting means and said heat-generating means.

28. The heat exchanger as defined in claim 25 including means for conducting the heat-exchange medium contiguous said heat-generating means while bypassing said outdoor coil means.

29. The heat exchanger as defined in claim 25 including means for restricting the flow of the heat-exchange medium into said outdoor coil means inlet.

30. The heat exchanger as defined in claim 25 including means for restricting the flow of the heat-exchange medium into said outdoor coil means inlet, said heat-exchange medium flows in a first direction from said inlet toward said outlet during the heating phase of said heat exchanger, and means for preventing flow of the heat-exchange medium in a second direction opposite said first direction during the simultaneous operation of said ambient air flow effecting means and said heat-generating means.

31. The heat exchanger as defined in claim 25 including means for restricting the flow of the heat-exchange medium into said outdoor coil means inlet when said heat-generating means is operating.

32. The heat exchanger as defined in claim 25 including means for restricting the flow of the heat-exchange medium into said outdoor coil means inlet when said heat-generating means is operating, and means for preventing the backflow of the heat-exchange medium into said outdoor coil means through said outlet when said heat-generating means is operating.

33. The heat exchanger as defined in claim 25 including means for collecting the heat-exchange medium, and said heat-generating means is effective for heating the collected heat-exchange medium.

34. The heat exchanger as defined in claim 1 wherein said control means is further operative for at times operating only said air flow effecting means while said heat generating means is inoperative.

* * * * *